US007603839B2

(12) United States Patent
Dooley

(10) Patent No.: US 7,603,839 B2
(45) Date of Patent: Oct. 20, 2009

(54) SCAVENGE PUMP SYSTEM AND METHOD

(75) Inventor: Kevin Allan Dooley, Mississauga (CA)

(73) Assignee: Pratt & Whitney Canada Corp., Longueuil (CA)

( * ) Notice: Subject to any disclaimer, the term of this patent is extended or adjusted under 35 U.S.C. 154(b) by 533 days.

(21) Appl. No.: 11/313,770

(22) Filed: Dec. 22, 2005

(65) Prior Publication Data

US 2007/0144138 A1 Jun. 28, 2007

(51) Int. Cl.
*F02C 7/06* (2006.01)

(52) U.S. Cl. ..... 60/39.08; 415/77; 184/6.11

(58) Field of Classification Search ..... 60/39.08; 415/77, 78, 79, 202; 184/6.11
See application file for complete search history.

(56) References Cited

U.S. PATENT DOCUMENTS

| | | | | |
|---|---|---|---|---|
| 1,597,467 | A | | 8/1926 | Hodgkinson |
| 2,226,892 | A | | 12/1940 | Betts |
| 2,526,281 | A | | 10/1950 | Ryan et al. |
| 2,848,284 | A | | 8/1958 | Atkinson et al. |
| 3,186,166 | A | | 6/1965 | Grieb |
| 3,270,495 | A | | 9/1966 | Connor |
| 3,275,148 | A | * | 9/1966 | Vicino ..... 210/167.02 |
| 3,635,589 | A | | 1/1972 | Kristiansen |
| 4,144,950 | A | | 3/1979 | Moyer et al. |
| 4,592,202 | A | | 6/1986 | Stewart et al. |
| 4,631,009 | A | | 12/1986 | Cygnor et al. |
| 4,714,139 | A | | 12/1987 | Lorenz et al. |
| 4,734,008 | A | | 3/1988 | Roth |
| 4,898,571 | A | * | 2/1990 | Epper et al. ..... 494/26 |
| 5,120,194 | A | * | 6/1992 | Nichols ..... 415/167 |
| 5,584,650 | A | | 12/1996 | Redmond et al. |
| 5,988,980 | A | | 11/1999 | Busbey et al. |
| 6,237,322 | B1 | | 5/2001 | Rago |
| 7,476,266 | B2 | * | 1/2009 | Hallgren et al. ..... 55/406 |

* cited by examiner

*Primary Examiner*—Michael Cuff
*Assistant Examiner*—Phutthiwat Wongwian
(74) *Attorney, Agent, or Firm*—Ogilvy Renault LLP

(57) ABSTRACT

The pump system extracts motive power from oil in the pressurized oil circuit to power a scavenge pump mounted on a scavenge oil circuit.

4 Claims, 4 Drawing Sheets

SCAVENGE PUMP SYSTEM AND METHOD

TECHNICAL FIELD

The invention relates generally to a system for pumping scavenge oil.

BACKGROUND OF THE ART

Scavenge pumps are found in devices which include a lubricating system. These pumps are useful to propel used oil back to an oil sump or tank under certain conditions, for instance when gravity or air pressure is not sufficient to move the used oil. Oil circulating in a scavenge oil circuit, and referred to herein as scavenge oil, is usually a mix of air and oil, which mixture forms a foam-like fluid. Scavenge pumps are often required at remote locations, namely locations that are relatively far from the oil sump or tank. For instance, in the case of a gas turbine engine, a scavenge oil circuit for a bearing cavity at the rear end of the engine may require the use of a scavenge pump. Existing arrangements involving scavenge pumps use mechanical or electrical power to be provided at the remote location where the scavenge pump is located. This external power is supplied by a dedicated external line and it requires appropriate control arrangements, such as a switch or an actuated valve, thereby adding weight and complexity to the device in which the scavenge pump is provided.

SUMMARY OF THE INVENTION

It is therefore an object of this invention to provide an improved scavenge pump system.

In one aspect, there is provided a scavenge pump system comprising: a motor to be mounted on a pressurized oil supply circuit and extracting motive power from oil in the pressurized oil circuit; and a scavenge pump to be mounted on a scavenge oil circuit, the scavenge pump being powered by the motor.

In another aspect, there is provided a scavenge pump system comprising: a turbine adapted to be driven by a pressurized oil supply; and a pump drivingly connected to the turbine, the pump adapted to scavenge oil from an oil scavenge circuit.

In another aspect, there is provided a method of scavenging oil, the method comprising: circulating pressurized oil in a pressurized oil supply circuit; generating rotational power using a flow of the oil in the pressurized oil supply circuit; and rotating a scavenge pump using said rotational power.

Further details on these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
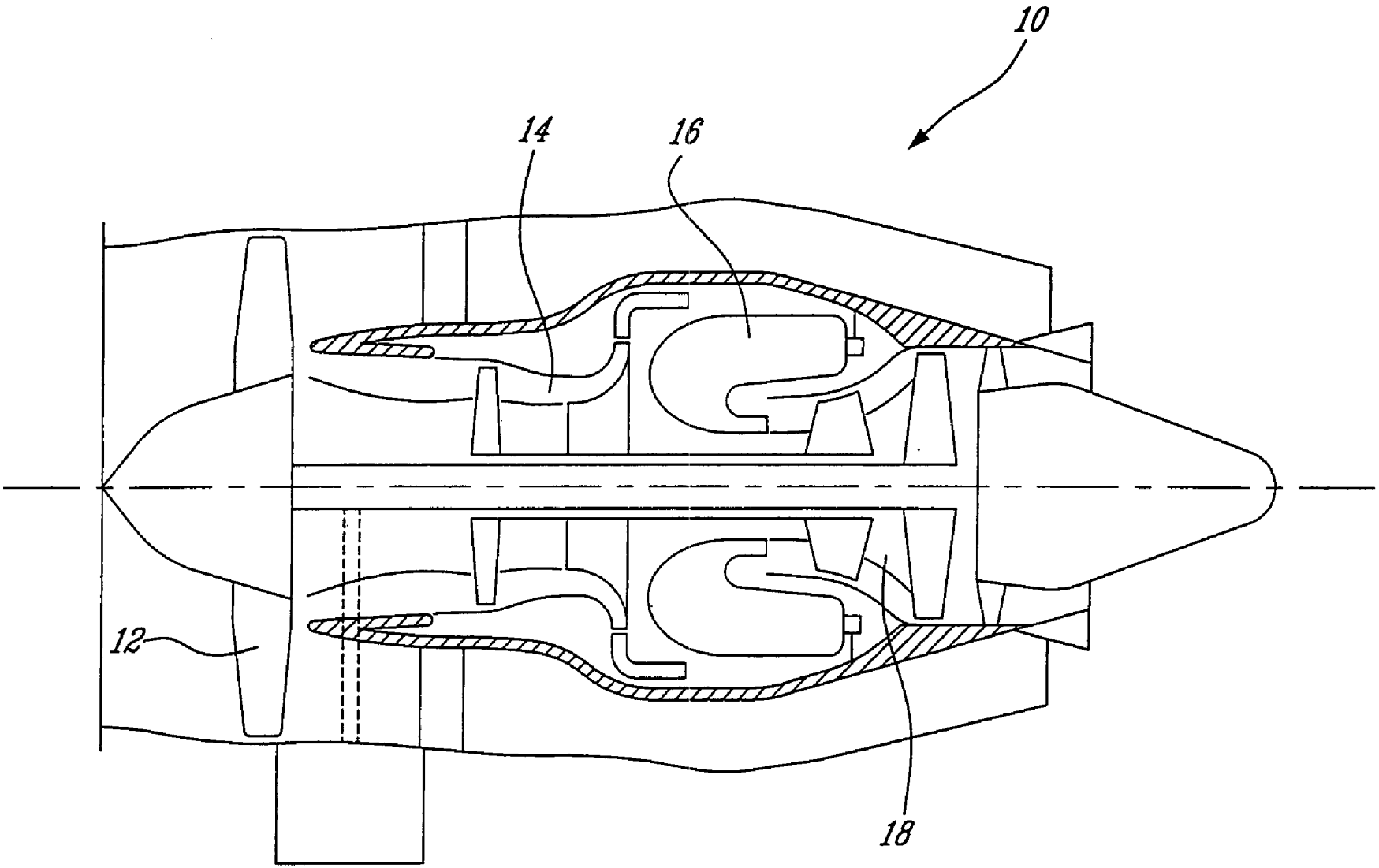
FIG. 1 is a schematic view of a multi-spool gas turbine engine showing an example of a possible environment in which the system and method can be used.

FIG. 1 illustrates an example of a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. The gas turbine engine 10 is a device in which scavenge pumps are often used and where the scavenge pump system and the method in accordance with the present invention would be very advantageous.

Figure 2:
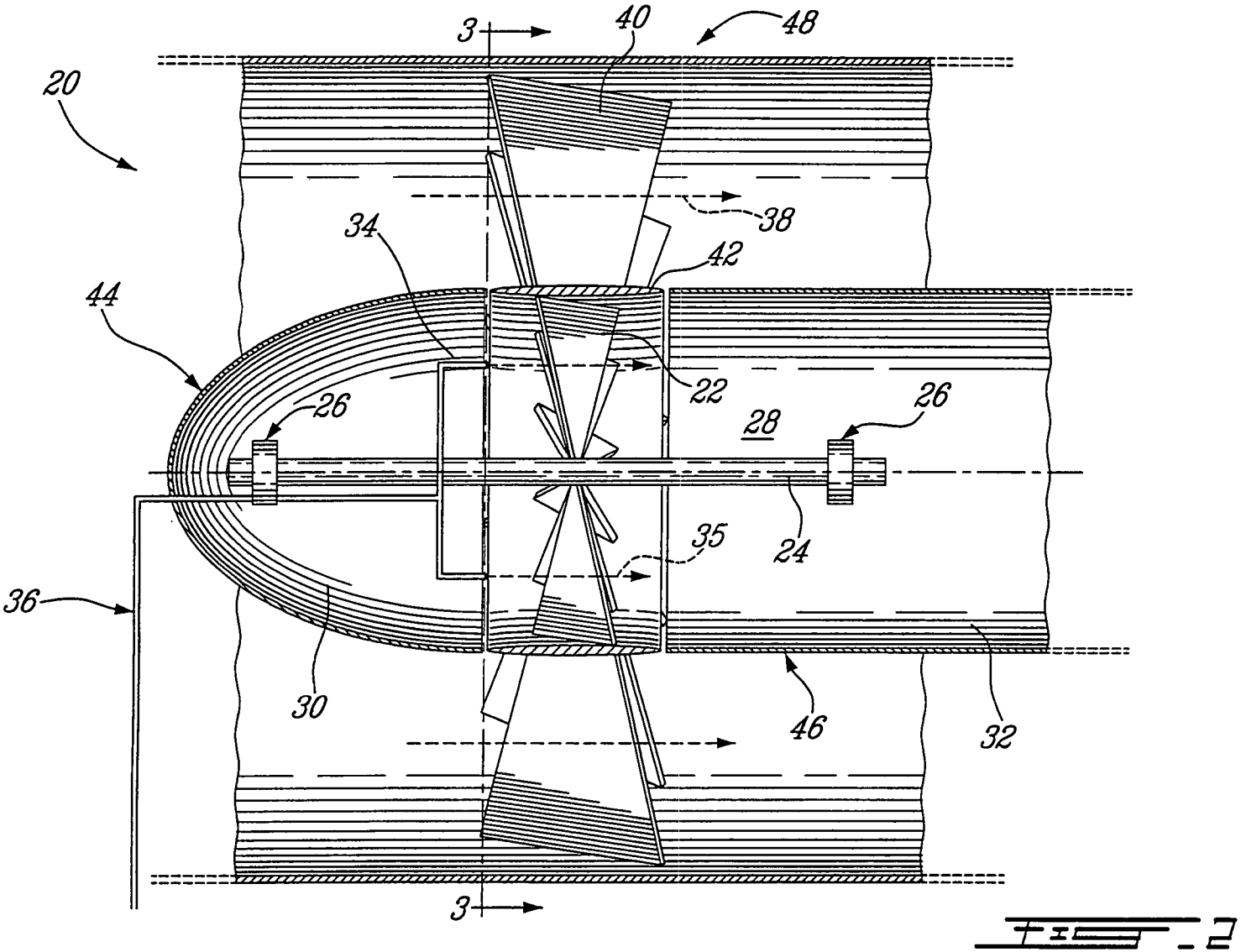
FIG. 2 is a axial view of an example of a system in accordance with a possible embodiment.
Figure 3:
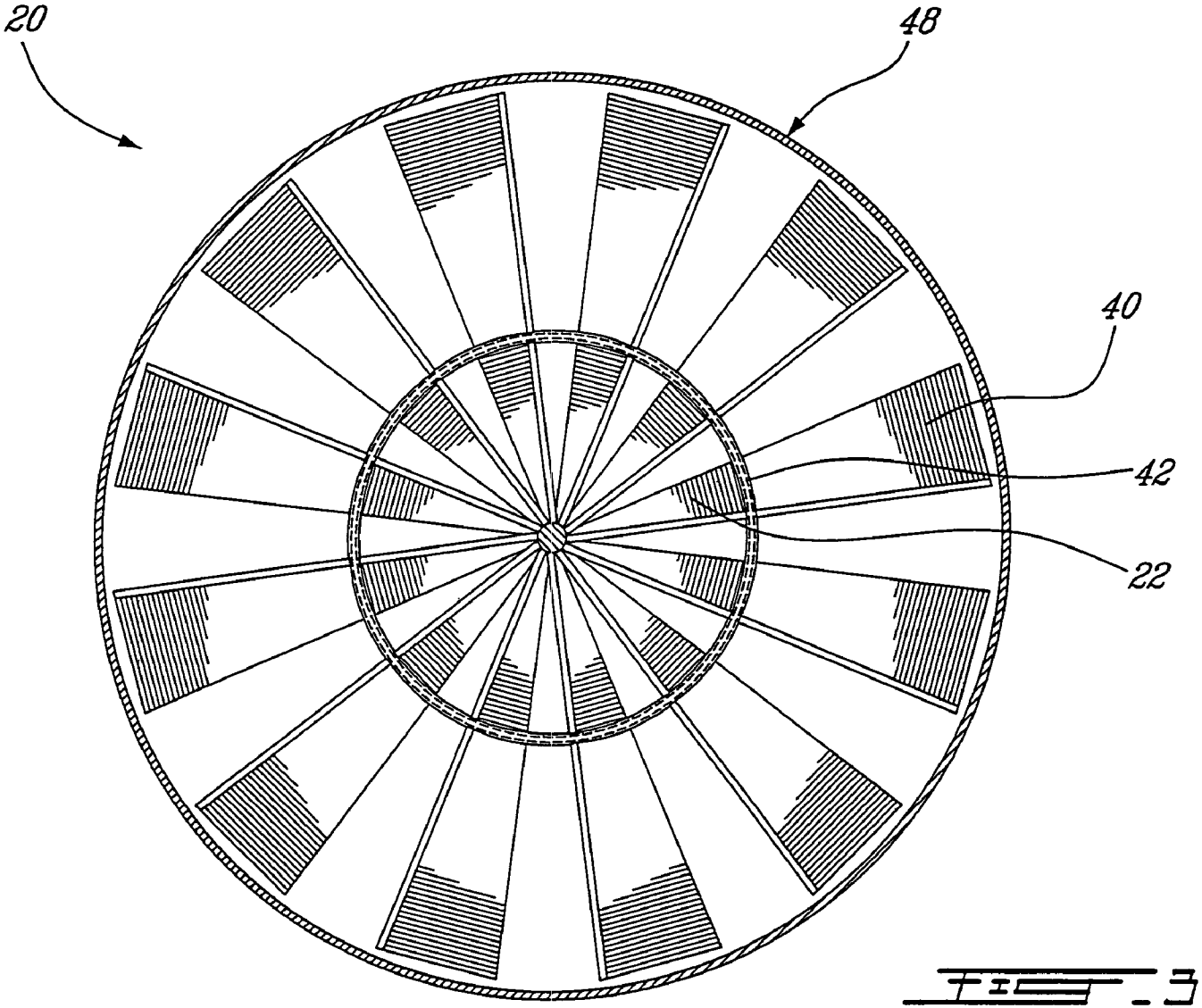
FIG. 3 is a cross-sectional view of the system taken along line III-III in FIG. 2.

FIGS. 2 and 3 illustrate an example of a scavenge pump system 20 in accordance with a possible embodiment of the present invention. This scavenge pump system 20 comprises a motor in the form of a turbine 22 that is mounted around a shaft 24 supported between two bearings 26. The turbine 22 is provided in a chamber 28 having an inlet side 30 and an outlet side 32. The inlet side 30 is provided with nozzles 34 located in front of the turbine 22. These nozzles 34 are connected to a pressurized oil supply circuit 36. This circuit 36 carries the oil to the structure or structures requiring lubrication, such as gears or bearings. Thereafter, the scavenge oil flows back to the oil sump or tank through the scavenge oil circuit 38.

The turbine 22 is configured and disposed to be driven into rotation by oil flowing out of the nozzles 34. In use, the nozzles 34 create pressurized oil jets 35 impinging on the blades of the turbine 22 and generating a rotation of the turbine 22 around its shaft 24. This arrangement allows extracting motive power from the oil and transferring it to the turbine 22 when oil flows in the pressurized oil supply circuit 36. Oil then flows out of the chamber 28 through the outlet side 32 and it is sent to the structure or structures requiring lubrication.

It should be noted at this stage that in some designs, it is possible to have only a portion of the oil from the pressurized oil supply circuit 36 sent through the turbine 22. The entire flow of oil may otherwise be used to rotate the turbine 22.

The scavenge pump system 20 further comprises a scavenge pump 40 mounted on the scavenge oil circuit 38. The scavenge pump 40 provides the necessary impulse to the scavenge oil to be sent back to oil sump or tank. The scavenge pump 40 is powered by the turbine 22. This way, the scavenge pump system 20 is autonomous and does not require any external power or any control arrangement since the scavenge pump 40 would need to operate whenever oil flows into the pressurized oil supply circuit 36.

In the illustrated embodiment, the scavenge pump 40 is connected to the turbine 22 by the fact that it is concentrically mounted on it. Moreover, they are different portions of a same blade. The system 20 is designed so that the pressurized oil supply circuit 36 and the scavenge oil circuit 38 remain independent at this level. An intermediary wall 42 separates the pressurized oil supply circuit 36 and the scavenge oil circuit 38 between the turbine 22 and the scavenge pump 40. Other internal and external walls 44, 46, 48 complete the system 20.

Figure 4:
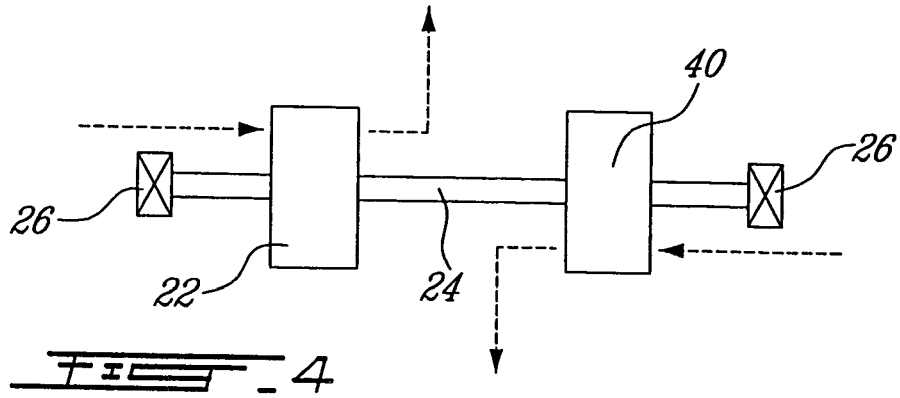
FIGS. 4 to 7 are schematic views showing different possible configurations of the scavenge pump system.
Figure 5:
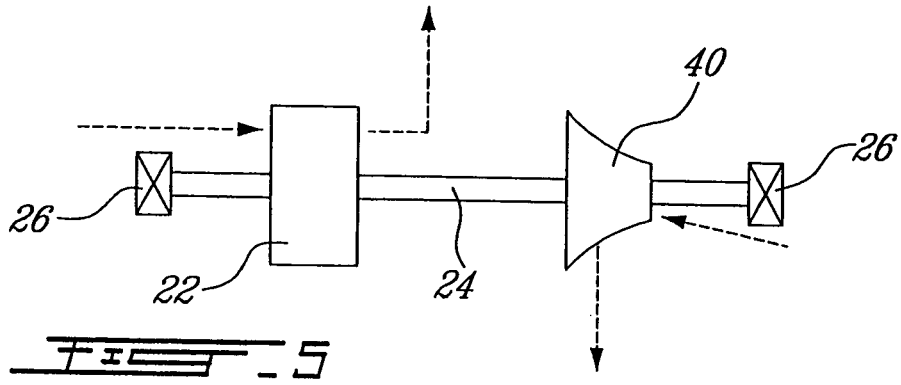
Figure 6:
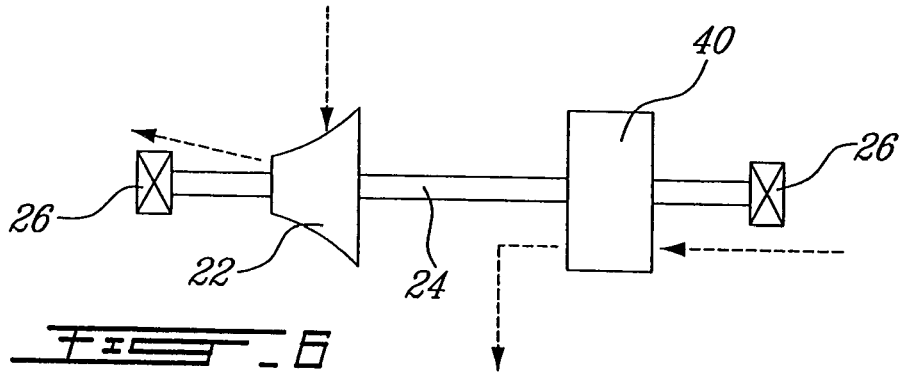
Figure 7:
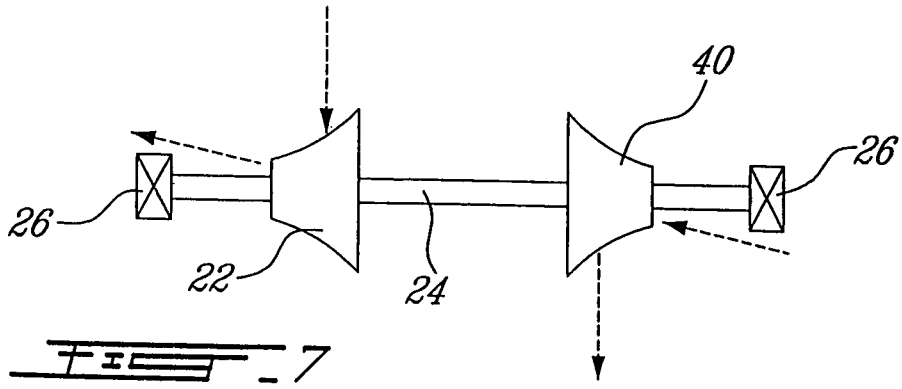

The above description is meant to be exemplary only, and one skilled in the art will recognize that changes may be made to the embodiments described without departing from the scope of the invention disclosed. For instance, oil flowing in the pressurized oil supply circuit does not necessarily need to flow in the same direction as that of the scavenge oil. The system could be designed so that both are flowing in opposite directions. The scavenge pump 40 and the turbine 22 do not necessarily have to be directly connected together as illustrated in FIGS. 2 and 3. The pump 40 and the turbine 22 can be mechanically connected using a shaft, a gear box, a transmission belt, etc. For instance, FIGS. 4-7 show the turbine 22 and the scavenge pump 40 as two adjacent parts on the same shaft 24. FIG. 4 further shows that the turbine 22 may be an axial turbine and that the pump 40 may be an axial pump, both being mounted back to back in a configuration similar to an automotive supercharger. FIG. 5 shows that the turbine 22 may be an axial turbine and that the pump 40 may be a radial pump. FIG. 6 shows that the turbine 22 may be a radial turbine and that the pump 40 may be an axial pump. FIG. 7 shows that the turbine 22 may be a radial turbine and that the pump 40 may be a radial pump.

Furthermore, the motive power can also be transmitted between the turbine and the scavenge pump using an electrical generator connected to the motor, and an electrical motor connected to the scavenge pump. The motor which is provided on the pressurized oil supply circuit can be any suitable kind of motor to be driven by the pressurized oil, including a motor that is not a turbine. Furthermore, oil flowing in the pressurized oil supply circuit is not necessarily sent back to the oil sump or tank using the scavenge oil circuit associated with the pressurized oil circuit. More than one pressurized oil supply circuit can be present in a device and in some designs, the oil or a portion thereof can flow back through another scavenge oil circuit of the device. The system and method can be used in devices that are not gas turbine engines, although the system and method are particularly useful for gas turbine engines since it allows reducing the weight and the number of parts. Still other modifications of the present invention will be apparent to those skilled in the art, in light of a review of this disclosure.

What is claimed is:

1. A scavenge pump system for scavenging oil from a plurality of bearing chambers of a gas turbine engine, the gas turbine engine having: a compressor; and a turbine driven by hot gas from a combustor, mounted on at least one shaft mounted for rotation about an axis on a plurality of bearings housed in said bearing chambers, the gas turbine engine including an oil supply circuit having a pressurized oil supply conduit to each bearing chamber and an oil scavenge circuit from each bearing chamber, the scavenge pump system comprising: a turbine having an inlet and an outlet each in flow communication with the pressurized oil supply circuit, the turbine being powered to rotate on a turbine shaft in response to pressurized oil flow over the turbine and extracting motive power from the flow of oil through the pressurized oil circuit; and a scavenge pump having an inlet and an outlet each in flow communication with the scavenge oil circuit, the scavenge pump being mechanically connected to and powered by the turbine shaft.

2. The system as defined in claim 1, wherein the turbine and the scavenge pump are concentrically mounted with reference to a rotation axis of the turbine.

3. The system as defined in claim 2, wherein the turbine and the scavenge pump are different portions of a same blade, both portions being separated by an intermediary wall.

4. The system as defined in claim 2, wherein the turbine is selected from the group consisting of: an axial turbine; and a radial turbine, and the scavenge pump is selected from the group consisting of: an axial pump; and a radial pump.

* * * * *